United States Patent [19]

Keyes, IV et al.

[11] 4,250,558

[45] Feb. 10, 1981

[54] HYBRID ANALOG FUNCTION GENERATOR

[75] Inventors: Marion A. Keyes, IV, Chagrin Falls; Jack W. Malcolm, Louisville; William L. Thompson, Chardon, all of Ohio

[73] Assignee: The Babcock & Wilcox Company, New Orleans, La.

[21] Appl. No.: 7,078

[22] Filed: Jan. 29, 1976

[51] Int. Cl.[3] ..... G06J 1/00

[52] U.S. Cl. ..... 364/607; 364/606

[58] Field of Search ..... 364/607, 608, 606, 605, 364/602, 718, 851, 852

[56] References Cited

U.S. PATENT DOCUMENTS

| | | | |
|---|---|---|---|
| 3,435,193 | 3/1969 | Aitchison | 364/606 |
| 3,469,080 | 9/1969 | Schmid et al. | 364/606 |
| 3,701,145 | 10/1972 | Bergin | 364/607 X |
| 3,772,681 | 11/1973 | Skingle | 364/607 X |
| 4,156,915 | 5/1979 | Hasenbalg et al. | 364/607 X |
| 4,159,526 | 6/1979 | Mosley, Jr. et al. | 364/607 X |

FOREIGN PATENT DOCUMENTS

| | | | |
|---|---|---|---|
| 1496571 | 12/1977 | United Kingdom | 364/607 |

OTHER PUBLICATIONS

Markham, "Vector Generator with 256 Programmable Values", Electronic Engineering, vol. 48, No. 579, pp. 22–23, May 1976.

Analog Function Generation Using ROM's, Texas Instruments Application Brief B141 (2 pages), Apr. 1974.

*Primary Examiner*—Joseph F. Ruggiero

*Attorney, Agent, or Firm*—Robert J. Edwards; Vytas R. Matas; John F. Luhrs

[57] ABSTRACT

A hybrid analog function generator producing an adjustable time delayed analog output signal varying in predetermined non-linear relationship with an analog input signal wherein the analog input signal is converted to a first digital signal addressing a programmable read only memory which is programmed to produce a second digital signal, corresponding to the predetermined function of the analog input signal, which is converted to a proportional analog output signal and wherein a selected digital number can be added to the first digital signal and wherein the quotient of a first analog input signal divided by a second analog input signal can be converted to the first digital signal and wherein an analog output signal can be generated which is proportional to the second digital signal multiplied by a third analog input signal.

5 Claims, 1 Drawing Figure

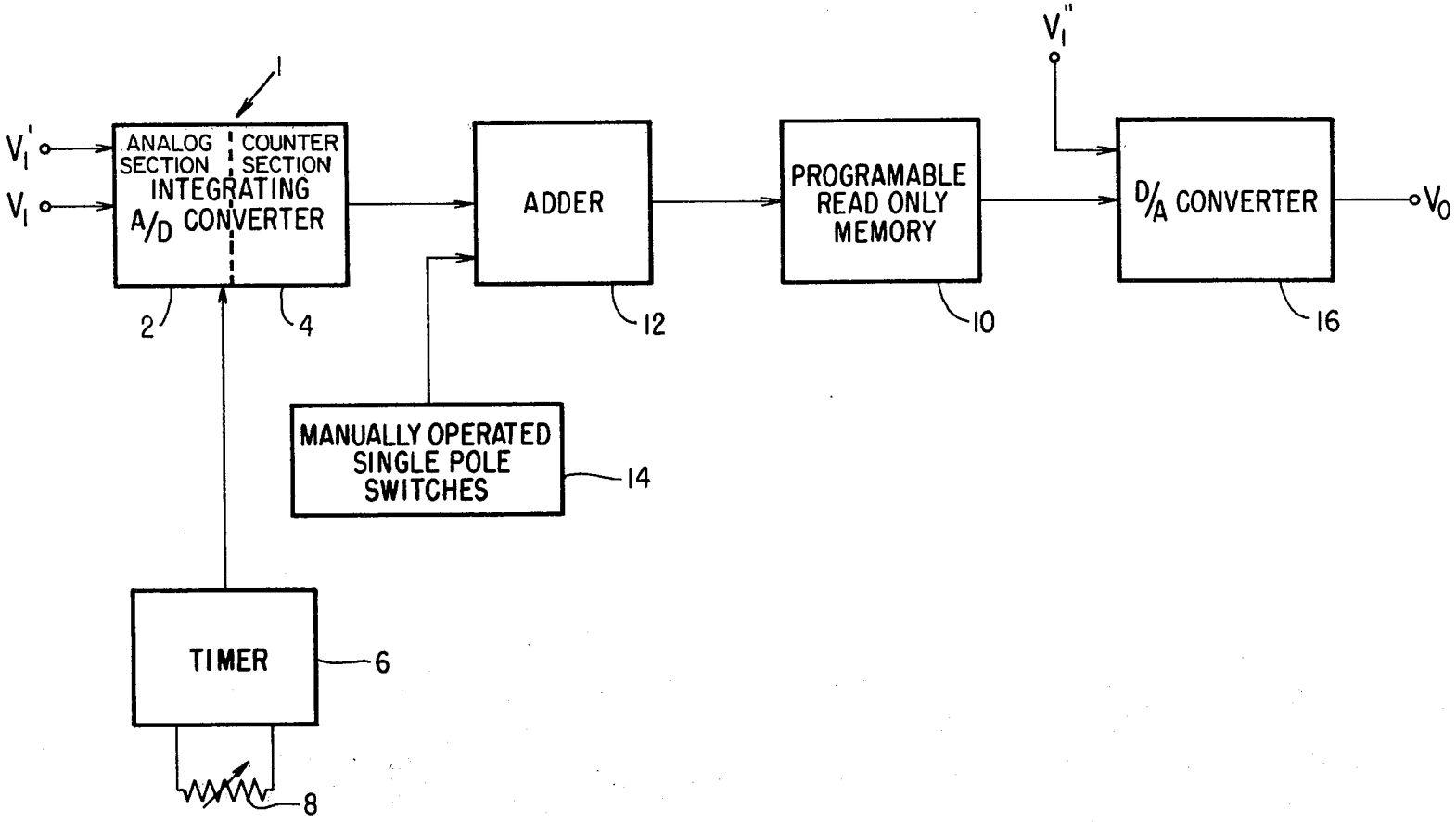
ANALOG SECTION
COUNTER SECTION
INTEGRATING A/D CONVERTER
ADDER
PROGRAMABLE READ ONLY MEMORY
D/A CONVERTER
MANUALLY OPERATED SINGLE POLE SWITCHES
TIMER
1
2
4
6
8
10
12
14
16
V'I
VI
V''I
VO

HYBRID ANALOG FUNCTION GENERATOR

This invention relates to a function generator for producing an analog output signal corresponding to a predetermined non-linear function of an analog input signal. More particularly it relates to a hybrid analog function generator wherein an analog input signal is converted to a proportional digital signal addressing a programable read only memory programmed to generate a digital output signal, corresponding to the predetermined function of the input signal, which is converted to a proportional analog output signal.

In accordance with this invention an analog output signal can be generated which varies in predetermined functional relationship to the quotient of one analog input signal divided by another analog input signal.

Further in accordance with this invention an analog output signal can be generated which varies in predetermined functional relationship to the product of one analog input signal multiplied by another analog input signal.

Further in accordance with this invention an analog output signal can be generated which varies in predetermined functional relationship to the quotient of one analog input signal divided by another analog input signal multiplied by still another analog input signal.

Further in accordance with this invention a selected time delay can be introduced between the input signal to the function generator and output signal therefrom.

Further in accordance with this invention a selected digital signal can be added to or subtracted from the digital signal addressing the programable read only memory.

It is a further object of this invention to provide an analog function generator wherein the functional relationship between the input and output signals can be varied without a change in hardware to thereby adapt a generator to a wide variety of applications such as, but not limited to, square root extraction as required in generating an output signal varying in straight line relationship to rate of fluid flow; extraction of the non-linear function between the e.m.f. generated by a thermocouple and temperature, or the non-linear function between the resistance of a resistant thermometer and temperature; extraction of the non-linear function between temperature and the rate of a chemical reaction.

These and other objectives of the invention will be apparent as the description proceeds in connection with the drawing, in which:

IN THE DRAWING

The drawing is a block diagram of a hybrid analog function generator embodying the principles of this invention.

DETAILED DESCRIPTION

Illustrated in the drawing is an integrating analog to digital converter, generally indicated at 1, comprised of an analog section 2 and a counter section 4, which is supplied with pulses from a timer 6 at a constant but adustable frequency by means of a suitable circuit such as schematically indicated at 8.

An analog to digital converter, such as shown at 1, may be made up, for example, of a National Semiconductor Corp. LF13300 integrating A/D analog building block and a National Semiconductor Corp. MM5863 12-bit binary A/D building block or comparable components. The timer 6 may be a National Semiconductor Corp. LM555 timer which may be set to operate at a selected frequency, such as 250 KHZ, but adjustable as heretofore stated by a suitable adjusting means such as schematically illustrated at 8.

The digital output reading of the counter 4 is:

$$n_2=(V_I/V_I')\times n_1 \quad (1)$$

Where;

$n_2$=counter output reading $n_1$=number of timer pulses $V_I$=analog input signal to the A/D converter $V_I'$=analog input signal to the A/D converter From equation (1) it is apparent that if $V_I'$ is constant as by means of a suitable reference, $n_2$ is directly proportional to $V_I$. It is equally apparent that $n_2$ will vary inversely with $V_I'$. Thus the A/D converter 1 provides a means of obtaining a digital readout directly proportional to and input signal ($V_I$) or a digital readout proportional to the quotient of a first input signal ($V_I$) divided by a second input signal ($V_I'$).

From equation (1) it is also apparent that the time delay between input signals $V_I$ and $V_I'$ and the corresponding digital output signal from the A/D converter 1 can be varied by the adjusting means 8 as required to meet the exigencies of a particular application.

The digital readout of the A/D converter 1 inputs to and forms the address for a programable read only memory (PROM) 10, which may be made up of one or more Intel 2716 VV eraseable proms, programmed to produce a digital output signal having a predetermined or desired functional relationship to the address. As obvious, in some applications, a read only memory (ROM) would be satisfactory, however, a PROM permits changing the functional relationship, if required, while providing a secure function once programmed.

To facilitate zero adjustment of the function generator, an adder, such as shown at 12, can be interposed between the A/D converter 1 and PROM 10 whereby a number may be added to or subtracted from the address generated in the A/D converter 1 by means of manually operated single pole switches such as schematically shown at 14.

The digital output signal from the PROM 10 inputs to a D/A converter 16 which may be, for example, a National Semiconductor Corp. series DAC1285 converter generating an output signal ($V_O$). Also inputting to the D/A converter 16 is a signal $V_I''$ so that ($V_O$) varies in direct proportion thereto. Accordingly, if $V_I''$ is maintained constant, as by means of a constant reference (not shown), $V_O$ varies in direct proportion with the digital input signal to the D/A converter 16; whereas if $V_I''$ is a variable input signal, $V_O$ will be proportional to the digital output signal from the PROM 10 multiplied by $V_I''$.

We claim:

1. An analog function generator for producing an analog output signal varying in predetermined non-linear relationship to an analog input signal, comprising in combination, an A/D converter receiving said analog input signal generating a first digital signal proportional to said analog input signal, an adder receiving said first digital signal and an adjustable digital signal producing a second digital signal equal to the algebraic sum of said first digital signal and said adjustable digital signal, a PROM receiving said digital signal as an address programmed to generate a third digital signal varying in non-linear relationship with said second digital signal and a D/A converter receiving said third digital signal generating an analog output signal proportional to said third digital signal whereby said analog output signal varies in said predetermined non-linear relationship to said analog input signal.

2. An analog function generator as set forth in claim 1 further including a timer for generating pulses at a selected frequency and wherein said A/D converter is comprised of an integrating analog section periodically accepting a number of pulses proportional to the input signal and a counter section receiving said number of pulses and generating said first digital signal corresponding to said number of pulses.

3. An analog function generator as set forth in claim 2 further including means for adjusting the selected frequency of said pulses to thereby vary the time delay between said analog input signal and said first digital signal.

4. An analog function generator as set forth in claim 1 wherein said A/D converter receives a second analog input signal and generates a first digital signal proportional to the quotient of said first analog input signal divided by said second analog input signal.

5. An analog function generator as set forth in claim 1 wherein said D/A converter receives an analog input signal and generates an analog output signal proportional to the product of said second digital signal multiplied by said last named analog signal.

* * * * *

UNITED STATES PATENT AND TRADEMARK OFFICE

CERTIFICATE OF CORRECTION

PATENT NO. : 4,250,558
DATED : February 10, 1981
INVENTOR(S) : Marion A. Keyes, IV et al.

It is certified that error appears in the above—identified patent and that said Letters Patent is hereby corrected as shown below:

On the title page, the filing date should read:

-- January 29, 1979 --.

Signed and Sealed this

*Twelfth* Day of *May 1981*

[SEAL]

*Attest:*

RENE D. TEGTMEYER

*Attesting Officer*

*Acting Commissioner of Patents and Trademarks*